United States Patent [19]

Diggle, Jr. et al.

[11] 4,454,171

[45] Jun. 12, 1984

[54] METHOD FOR WET PROCESSING, DRYING AND MOISTURE CONDITIONING TUBULAR KNITTED FABRIC

[75] Inventors: Edmund A. Diggle, Jr., Oradell, N.J.; Andrew P. Cecere, Valley Stream, N.Y.

[73] Assignee: Samcoe Holding Corporation, Woodside, N.Y.

[21] Appl. No.: 458,989

[22] Filed: Jan. 18, 1983

Related U.S. Application Data

[63] Continuation of Ser. No. 214,202, Dec. 8, 1980, abandoned, which is a continuation of Ser. No. 27,919, Apr. 6, 1979, abandoned.

[51] Int. Cl.[3] ..... B05D 1/02

[52] U.S. Cl. ..... 427/209; 8/149.1; 8/151; 68/5 D; 427/424; 427/427

[58] Field of Search ..... 68/5 D; 34/23, 32, 155; 26/18.5, 80–85; 8/149.1, 151; 427/209, 424, 427

[56] References Cited

U.S. PATENT DOCUMENTS

| | | | |
|---|---|---|---|
| 799,761 | 9/1905 | Smith | 68/6 |
| 1,036,840 | 8/1912 | Haw | 68/5 D |
| 1,250,894 | 12/1917 | Kately et al. | 34/155 |
| 1,401,376 | 12/1921 | Thompson | 427/424 |
| 2,571,494 | 10/1951 | Spooner | 26/18.5 |
| 2,700,202 | 1/1955 | Redman et al. | 26/18.5 |
| 2,714,756 | 8/1955 | Redman | 26/18.5 |
| 2,792,616 | 5/1957 | Cone et al. | 26/18.5 |
| 2,885,763 | 5/1959 | Schreiner | 26/18.6 |
| 2,906,205 | 9/1959 | Speers | 101/416 R |
| 3,088,224 | 5/1963 | Cohn et al. | 34/159 |
| 3,222,895 | 12/1965 | Sheppard | 118/65 X |
| 3,838,000 | 9/1974 | Urbas | 34/26 X |

FOREIGN PATENT DOCUMENTS

| | | | |
|---|---|---|---|
| 722935 | 2/1955 | United Kingdom | 26/18.5 |
| 1105062 | 3/1968 | United Kingdom . | |

OTHER PUBLICATIONS

Sonic Development Corporation, *Sonicore Atomizing Nozzles*, Bulletin S-100, 1975.

*Primary Examiner*—Evan K. Lawrence

*Attorney, Agent, or Firm*—Mandeville and Schweitzer

[57] ABSTRACT

A process and apparatus for treatment of continuous lengths of tubular knitted fabrics, involving wet processing, drying and then moisture conditioning of fabric. The fabric web is impregnated with a finishing resin in a wet processor, and is passed through a dryer to both eliminate the water of the processing solution and to cure the residual resin. The fabric emerging from the dryer is both extremely hot and, typically, bone dry, a condition considered unsatisfactory for gathering and further processing. In the disclosed invention, fabric enters a moisture conditioning chamber, in the lower portion, passes under a condensation guard, and then is guided vertically upward between opposed sets of finely atomizing spray nozzles. The fabric continues an upward course for a distance, and then is guided to a folder or roll up device. A wetting agent is utilized to assure thorough penetration of the spray, and advantageously this is introduced by way of incorporating a so-called re-wetting agent in the resin processing material introduced in advance of the dryer. Alternatively, a wetting agent can be incorporated in the water supply leading to the spray nozzles. A cotton fabric can have its moisture content increased by 5% or more in the conditioning process, which significantly enhances the fabric for further processing and also improves subjective characteristics of the fabric, such as hand and feel.

9 Claims, 6 Drawing Figures

FIG. 7
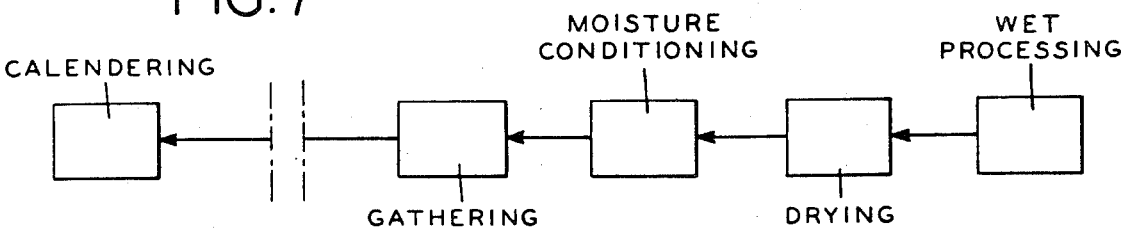
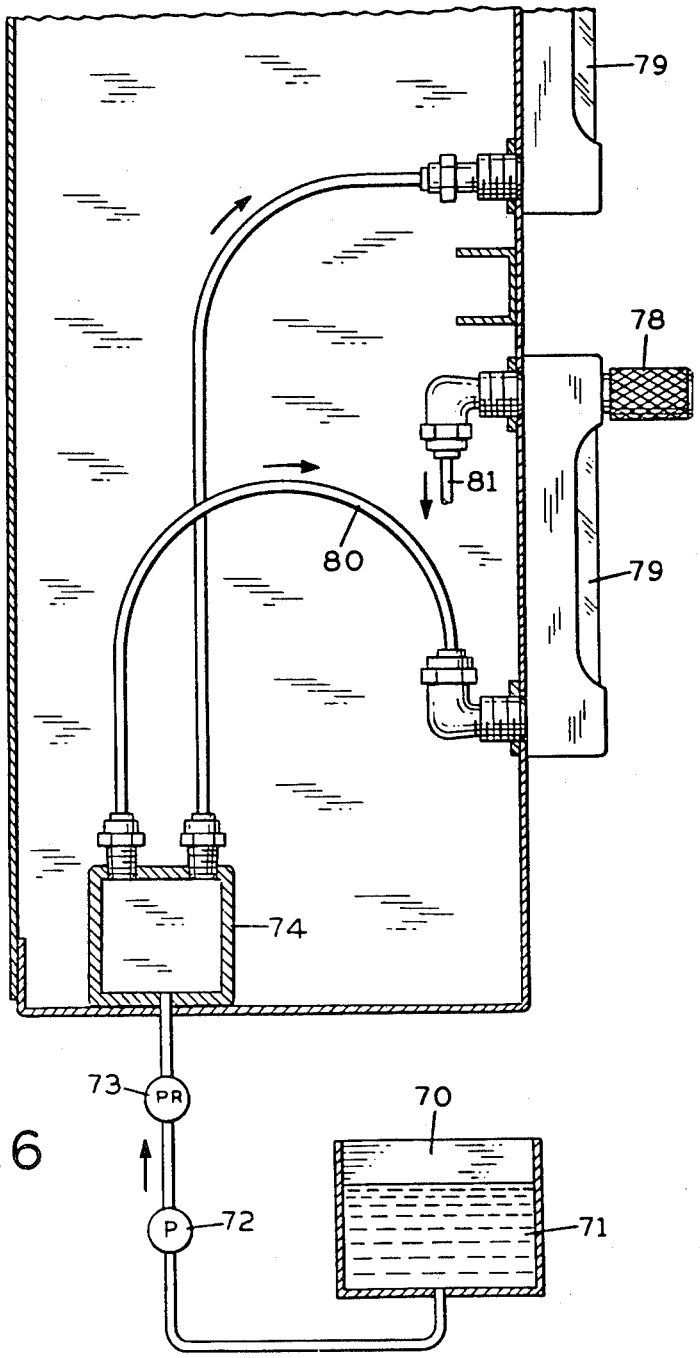
FIG. 6

METHOD FOR WET PROCESSING, DRYING AND MOISTURE CONDITIONING TUBULAR KNITTED FABRIC

This is a continuation of application Ser. No. 214,202, filed 12/8/80, abandoned, in turn a continuation. of Application Ser. No. 027,919, filed 4/6/79, now abandoned.

BACKGROUND AND SUMMARY OF THE INVENTION

In the processing of tubular knitted fabric, it is typical to provide for wet processing of the fabric, which is followed by drying. The processed fabric, emerging from the dryer, is typically at a relatively high temperature and is excessively dry. In some cases, it may be possible to leave some minimum degree of moisture in the fabric, by extremely careful control of the drying operation, but typically this is not very practical. In other cases, as where the wet processing operation prior to drying includes resin impregnation, the drying operation is utilized as a means for curing the resin in the fabric. This of course involves first driving off all of the moisture in the fabric, so that the temperature of the fabric may be raised to a sufficiently high level to effect curing of the resin, e.g., 325°-350° F. (163°-177° C.). Under these conditions, the fabric emerging from the dryer is both bone dry and extremely hot, and is not regarded as being in a desirable condition for gathering (e.g., by folding or rolling up) or for subsequent processing.

It has long been known to be desirable at this stage to remoisturize the fabric, substantially back to the moisture content that it will tend to regain naturally over a period of time. Also, in the case of fabric which has been dried at relatively high temperature for resin curing purposes, it is desirable to substantially reduce the temperature of the fabric before gathering. While the desirability of cooling and remoisturizing has long been known, accomplishing that objective with adequate uniformity and adequately high moisture regain, while at the same time avoiding condensation stains and the like, has proved to be elusive.

In accordance with the invention, tubular knitted fabric is wet processed in an extractor-pad or similar apparatus, which in itself may be of known design, and is then passed directly into a fabric dryer, which also may be of known design. Immediately adjacent the discharge end of the dryer there is provided a moisture conditioning station, through which the continuously moving web of tubular knitted fabric is directed. Importantly, the fabric web is arranged to enter a lower portion of the moisture conditioning chamber, and is guided veritcally upward therein during the conditioning process. If necessary, the fabric is directed vertically downward from the dryer discharge, in order to be able to enter the conditioning chamber at the proper level.

After moisture conditioning, the fabric is conveyed farther upward for a predetermined distance, providing at least a brief interval for thorough penetration of the moisture, after which the fabric may be engaged by guide rollers and guided to a gathering apparatus, which may be a folder or a roll up apparatus. The guide rollers are arranged whereby the apparatus-fabric surface contact conditions are relatively uniform on opposite sides of the fabric.

In accordance with certain specific aspects of the apparatus used to practice the method of the invention, the moisture conditioning chamber is provided with opposed sets of finely atomizing water spray nozzles, which are arranged in banks on each side, in closely spaced arrays, so as to be able to uniformly contact the full width of the fabric, on both sides, with finely atomized water spray mist. The fabric web advancing toward the sprays, is guided first in a generally horizontal direction, underneath a condensation guard. The fabric is then passed under a guide roller and directed vertically upward between banks of downwardly inclined spray nozzles. The condensation guard includes a forwardly projecting lip, which either lightly contacts or is in very close proximity to the plane of the upwardly moving fabric, to effectively prevent the migration of downwardly travelling condensation droplets toward and onto the horizontally moving, incoming fabric.

Tubular knitted fabric under any circumstances is an easily distortable material, and this is particularly true when moist. Accordingly, careful control is maintained over the tension in the fabric in the moisture conditioning zone.

In the process of the invention, a wetting agent is associated with the moisture conditioning step, in order to assure prompt and thorough penetration of the spray material and prevent its being held on the surface of the fabric. In some cases, this may be accomplished by introducing measured, small quantities of a wetting agent into the water supply leading to the spray nozzles. More advantageously, where the incoming fabric is resin treated in advance of drying, a rewetting agent may be incorporated in the resin solution, which enables ordinary water supplies to be utilized in the remoisturizing operation.

Pursuant to one of the more specific aspects of the apparatus used to practice the method of the invention, the moisture conditioning apparatus is constructed in a manner to simplify precise, individual control of each of a large plurality of spray nozzles, in order to assure virtual uniformity of moisture regain and conditioning across the full width of the fabric. To advantage, this is accomplished by providing a separately adjustable, visually observable flow rate gauge leading to each and every nozzle, such that the measured flow rate may be individually adjusted for each one. In addition, a master control valve is provided for adjusting the water flow to all the valves in common.

Important processing advantages are derived from the process of the invention, by reason of the advantageous moisture conditioning of the fabric. Among other things, it is possible for an all cotton tubular knitted resin treated fabric, being processed at a speed of about twenty-five yards per minute, to be given a moisture regain of as much as 5% or more during moisture conditioning. This amount of moisture regain can result in a significant increase in fabric width, in some cases as much as 1½ inches, and easily as much as one-half inch. This significantly facilitates the subsequent finish calendering operations, in which the fabric is required to be spread to a finish width. Where stripe straightening is required to be performed in the finishing operation, this is simplified by the greater pliability of the conditioned fabric. Even in subsequent processing, where the fabric is being sewed into garments, the moisture conditioning has an advantageous effect. Because of the higher levels of moisture, so-called needle cutting of the fabric, which is sometimes experienced during high speed sewing, is reduced. On the subjective side, the conditioned fabric has a noticeably more pleasant feel, being both silkier and softer than an unconditioned fabric.

For a more complete understanding of the above and other features and advantages of the invention, reference should be made to the following detailed description of a preferred embodiment and to the accompanying drawings.

DESCRIPTION OF THE DRAWINGS

FIG. 6 is a cross sectional view as taken generally on line 6—6 of FIG. 5.

FIG. 7 is a simplified schematic representation of a processing sequence for the treatment of tubular knitted fabric, including moisture conditioning.

DESCRIPTION OF A PREFERRED EMBODIMENT

Figure 1:
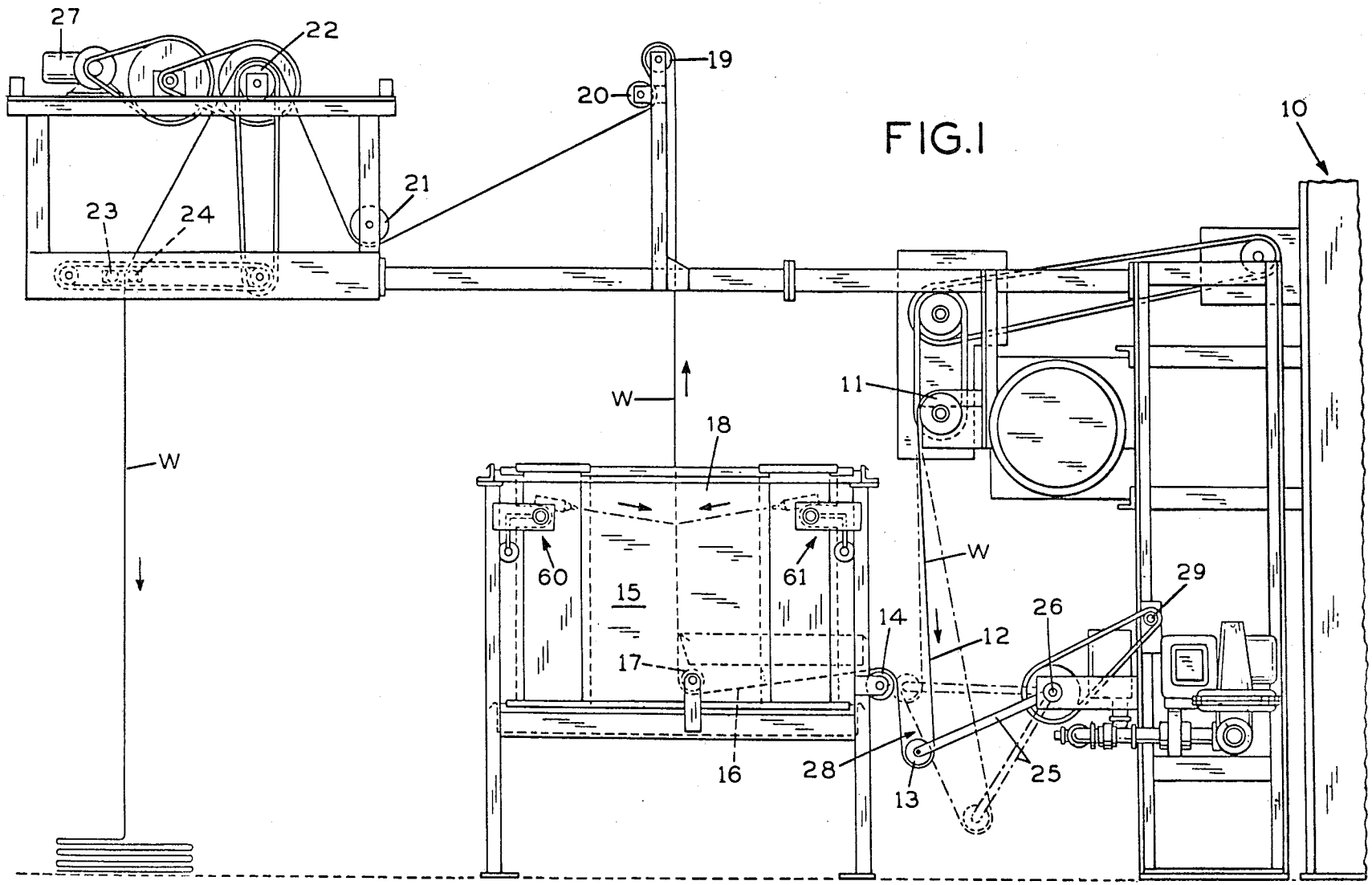
FIG. 1 is an elevational view of a portion of the apparatus utilized in the process of the invention, including a dryer, moisture conditioning unit and folder.

Referring now to the drawings, and initially to FIG. 1 thereof, the reference numeral 10 designates generally a dryer for continuously drying tubular knitted fabric, with only the discharge end area of the dryer being illustrated in the drawing. The dryer 10 may be of a known type, such as reflected in the S. Cohn et al. U.S. Pat. No. 3,065,551 or 3,102,006, for example. Within the contemplation of the present invention, the fabric will have been treated, immediately prior to drying, by being impregnated with a liquid processing solution. Any known apparatus (not shown) may be used for this purpose. Typically, but not by way of limitation, it may be advantageous to utilize a three-roll extractor-pad apparatus of the type described in the S. Cohn U.S. Pat. No. 3,207,616, for example.

Regardless of the apparatus utilized, the invention contemplates the processing of a continuous web of tubular knitted fabric by first uniformly impregnating the fabric with a liquid processing material, typically in a processing pad, after which the fabric is directed into the dryer 10 for removal of excess moisture. In the dryer, the fabric is exposed to streams of high temperature air while being retained in a generally tension free condition. This serves to drive off the moisture content of the fabric, leaving substantially dry fabric to be discharged at the exit end. The specific treatment of the fabric in the dryer 10 depends somewhat upon the nature of the wet processing applied thereto. In all instances with which the invention is concerned, fabric will be discharged from the dryer with a substantially lower moisture content than is either normal or desired for the fabric. In the case of resin treated fabric, the fabric may also be at a substantially elevated temperature required to effect curing of the resin.

In the illustrated system, the fabric web W leaves the dryer 10 at a discharge roller 11 and follows a generally downward course 12 to and around a dancer roll 13. From the dancer roll 13, the fabric web travels upward, around an entry roll 14 forming part of the moisture conditioning apparatus, generally designated by the numeral 15. The entry roll 14 is located to guide the fabric web into the lower portion of the moisture conditioning apparatus, through a generally horizontal entry course 16 to and around an internal guide roller 17. From the guide roller 17, the fabric travels substantially vertically upward through a moisturizing chamber 18, exiting from the top of the chamber and then travelling farther upward to and sinously around a pair of upper guide rollers 19, 20. From the guide rollers 19, 20, the fabric passes generally downward and around a folder entry roll 21, upward and around a folder feed roll 22 and then downward between horizontally reciprocating folder guide rollers 23, 24.

Desirably, the dryer apparatus 10 is run at a preset primary speed, and the folder apparatus is controlled as a slave to the dryer. In this respect, the dancer roll 13 is supported by arms 25 pivoted at 26. If the folder apparatus, which is driven by a motor 27, tends to advance the fabric at a rate faster than it is discharged from the folder, a nominal loop 28, formed in the fabric as it passes under and around the dancer roll 13, becomes shorter and raises the dancer roll and its supporting arms 25. Through a rotary control device 29, the speed of the folder drive 27 is proportionately decreased, tending to bring the loop 28 back toward its nominal size. If the loop tends to become excessively large, the controlling device 29 functions to correspondingly accelerate the folder, as will be understood.

In the apparatus used to practice the method of the illustrated form of the invention, the moisture conditioning apparatus 15 consists of a primary frame 30 (see FIG. 2), which may be of angle iron construction, for example, comprising a plurality of vertical supports 31 to which are secured upper and lower rectangular frames 32, 33, which may also be formed of angle stock. The lower frame 33 supports a condensate collection pan 34, formed of sheet metal and having short, upstanding sidewalls 35.

Figure 2:
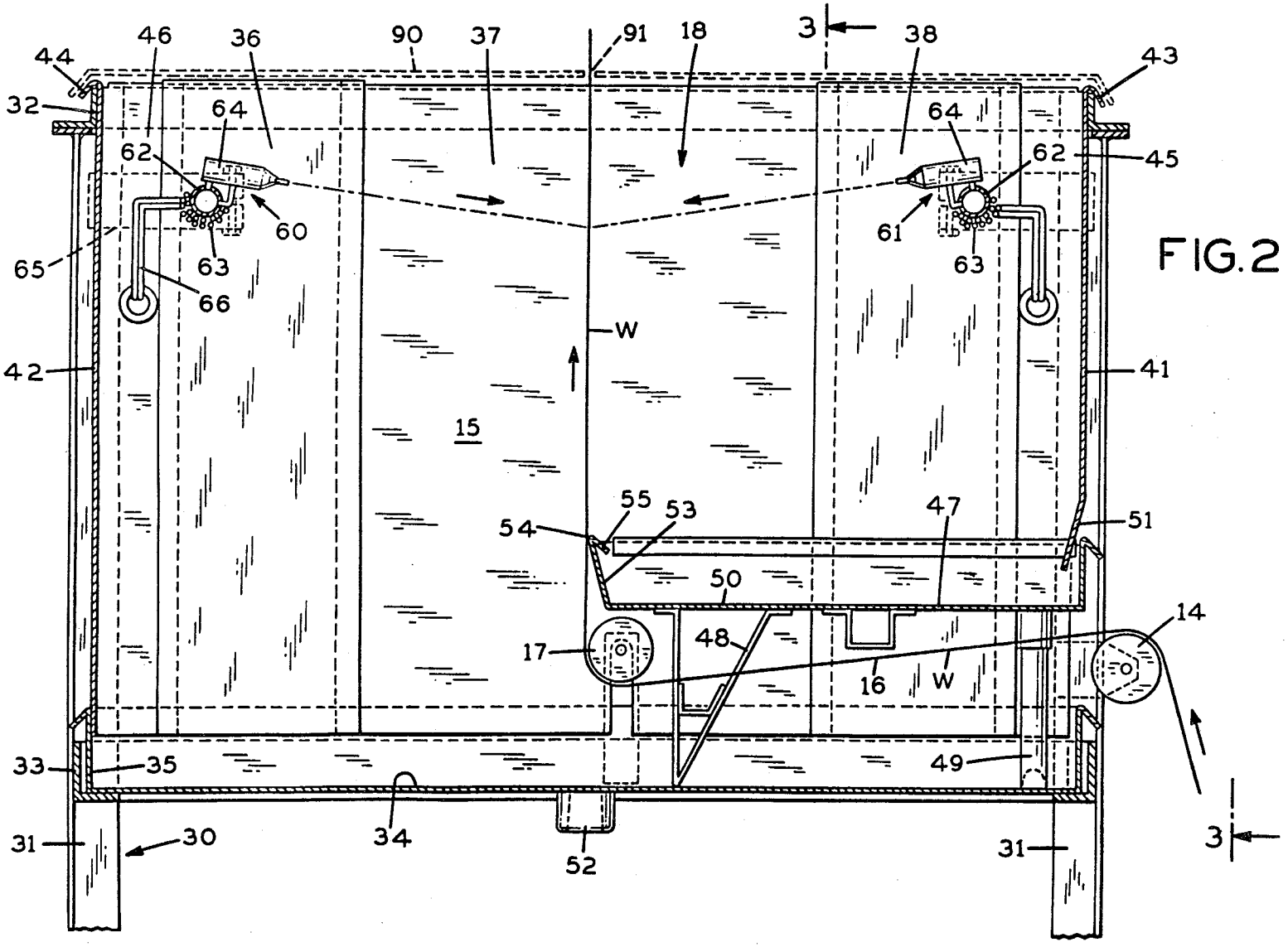
FIG. 2 is an enlarged, cross sectional view illustrating details of construction of the moisture conditioning unit incorporated in the system of FIG. 1.

The primary sidewalls of the moisture conditioning chamber 18 are formed of sheet metal panels suspended from the upper horizontal frame 32. Thus, as reflected in FIG. 2, for example, one sidewall of the chamber 18 is formed by sheet metal panels 36, 37, 38, which are provided at their upper extremities with outwardly and downwardly turned flanges 39 (see FIG. 3) engageable with the vertically extending flanges 40 of the upper frame 32. As shown in FIG. 2, the main panels 36–38 partially overlap with each other, and extend downward to a point inside of and slightly below the upper edge of the walls 35 of the condensate pan 34. A similar arrangement of suspended, partially overlapping panels is provided to form the two sidewalls of the moisture conditioning apparatus. The front and back walls may be formed by single panels, also suspended by flanges 43, 44 from the rectangular upper frame structure 32. In the illustrated arrangement, the front and back panels 41, 42 have right angularly bent portions 45, 46 at each side extremity, forming limited portions of the respective sidewalls, and overlapping slightly with the primary sidewall panels 36 and 38. The back wall panel 42 extends downward into the main condensate pan 34, while the front wall 41 extends into an auxiliary condensate pan 47.

The auxiliary condensate pan 47 is mounted on laterally spaced legs 48, 49, which raise the bottom level 50 of the pan above the level of the entry roller 14 and the internal guide rollers 17, providing a horizontal path 16 for the passage of the web underneath the auxiliary pan. The legs 48, 49 are spaced far enough apart to straddle the web on opposite sides, and the pan itself is of sufficiently greater width than the web W as to provide effective overhead shielding for the web during its horizontal traverse over to the internal guide roll 17. As reflected in FIG. 2, a lower lip 51 of the front wall 31 overlaps on the inside of the auxiliary pan 47, such that any condensate forming on the wall 41, in the area above the web W, will drain the pan. Beyond the side edges of the auxiliary pan, which is also well beyond the side edges of the web, any condensate on the front wall 41 will drain into the main condensate pan 34. One or more of the legs 49 of the auxiliary pan 47 is in the form of a hollow tube, providing for discharge of the collected condensate from the auxiliary pan into the main pan 34. From the latter, condensate is led through an exit drain 52 to a suitable place of discharge.

As reflected in FIGS. 1 and 2, the back wall 53 of the auxiliary pan angles rearward slightly, at a narrow angle to the vertical, and is provided along its upper edge 54 with an inturned flange 55. The positioning of the pan 47 is such that the rounded edge 54 lightly touches, or is otherwise positioned in very close proximity to the vertically travelling web W, as it extends from the internal guide roll 17 to the upper guide rolls 19, 20. With this arrangement, any gravitationally descending water overspray or condensate is effectively prevented from reaching any part of the horizontally travelling web, as it passes in underneath the auxiliary pan 47 and around the guide roller 17. Of course, any such gravitationally descending condensate which is behind the vertical path of the web falls harmlessly into the primary condensate pan 34.

Pursuant to one aspect of the apparatus used to practice the method of the invention, opposed banks 60, 61 of water spray nozzles are mounted in the moisture conditioning chamber 18, directed downwardly at an angle to the vertical plane of the fabric. In the illustrated arrangement, the water nozzles 64 desirably are "Sonicore" nozzles, as manufactured by Sonic Development Corporation, Upper Saddle River, N.J., or equivalent air atomizing nozzles. The Sonicore nozzle of choice for the intended application is the manufacturer's number 052HF, which is a low water flow series nozzle, adapted to discharge low volumes of air atomized water in an extemely finely divided mist. In the illustrated practical embodiment of the invention, a series of sixteen such nozzles is arranged on each side of the plane of the fabric, spaced apart on approximately three inch centers and spaced approximately twenty inches from the fabric, along the axes of discharge of the sprays. In this respect, the banks of atomizing nozzles advantageously are directed somewhat downwardly, at a small angle of, say, 10° from the horizontal. The opposed nozzle banks 60, 61 are substantially equally spaced from the vertical plane of the fabric, and the axes of discharge of opposed nozzles substantially intersect at that plane, more or less as reflected in FIG. 2.

To advantage, each of the nozzle banks 60, 61 includes an air supply header pipe 62, 63, which also serves as a physical mounting for the individual nozzles 64. In the illustrated arrangement, mounting brackets 65 extend from the frame uprights 31 and clamp opposite end regions of the header pipes 62, 63. The header pipes are normally fixed, but rotational adjustment is accommodated by the mounting arrangement.

Each of the nozzles of each bank is supplied independently, through its own individual water supply tube 66, with water to be atomized and discharged. As will be discussed more fully hereinafter, the rate of flow of water to each nozzle is individually precision adjusted, to assure that substantially identical atomized discharge from each nozzle is realized. The process is not nearly so sensitive to pressure and flow variations in atomizing air, and thus all of the nozzles of a single bank may be supplied with atomizing air from a common header pipe, with atomizing air pressure control being exerted upstream of the manifold, and not individually for the several nozzles.

Figure 3:
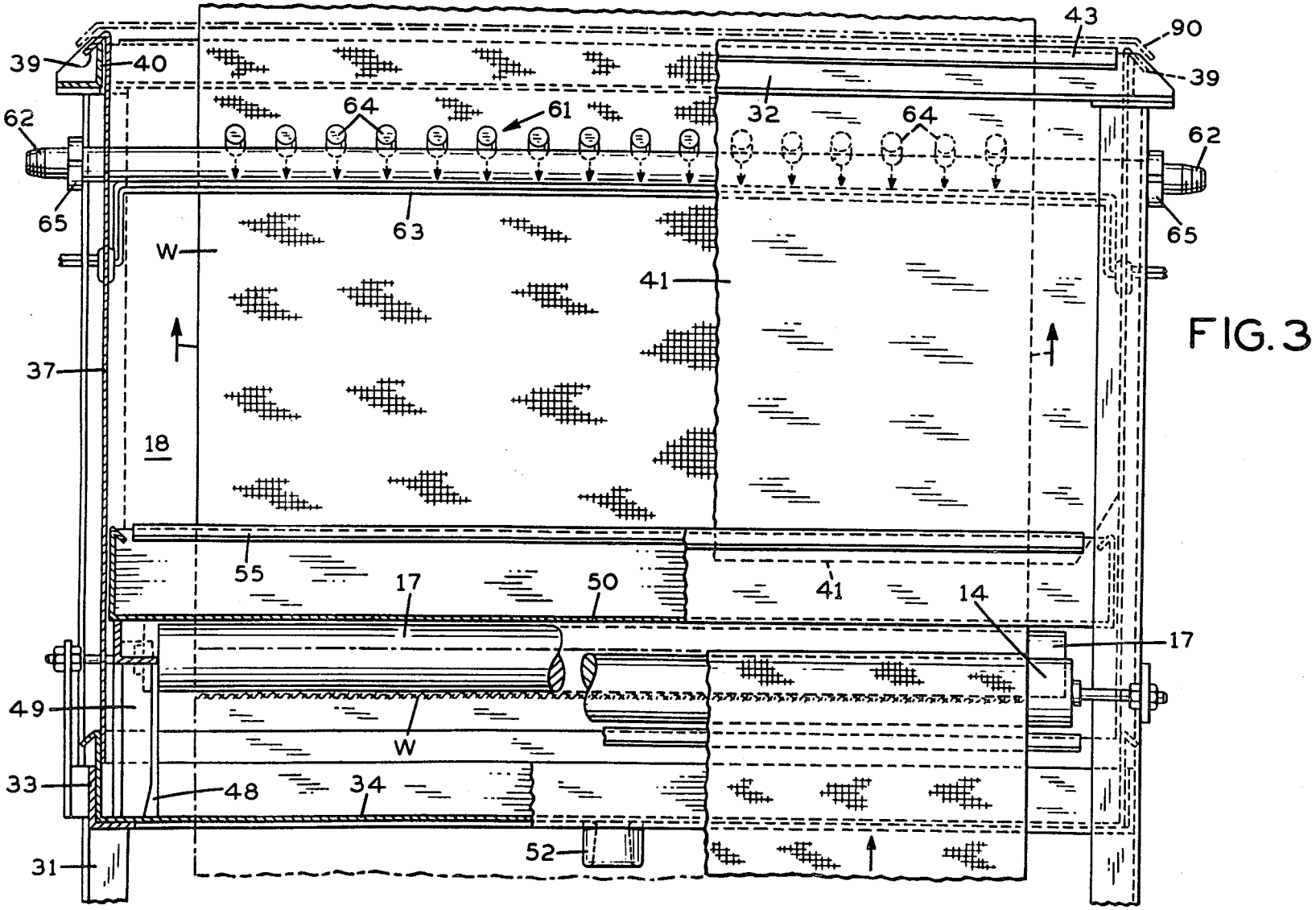
FIG. 3 is a transverse cross sectional view of the moisture conditioning unit, as taken generally on line 3—3 of FIG. 2.
Figure 4:
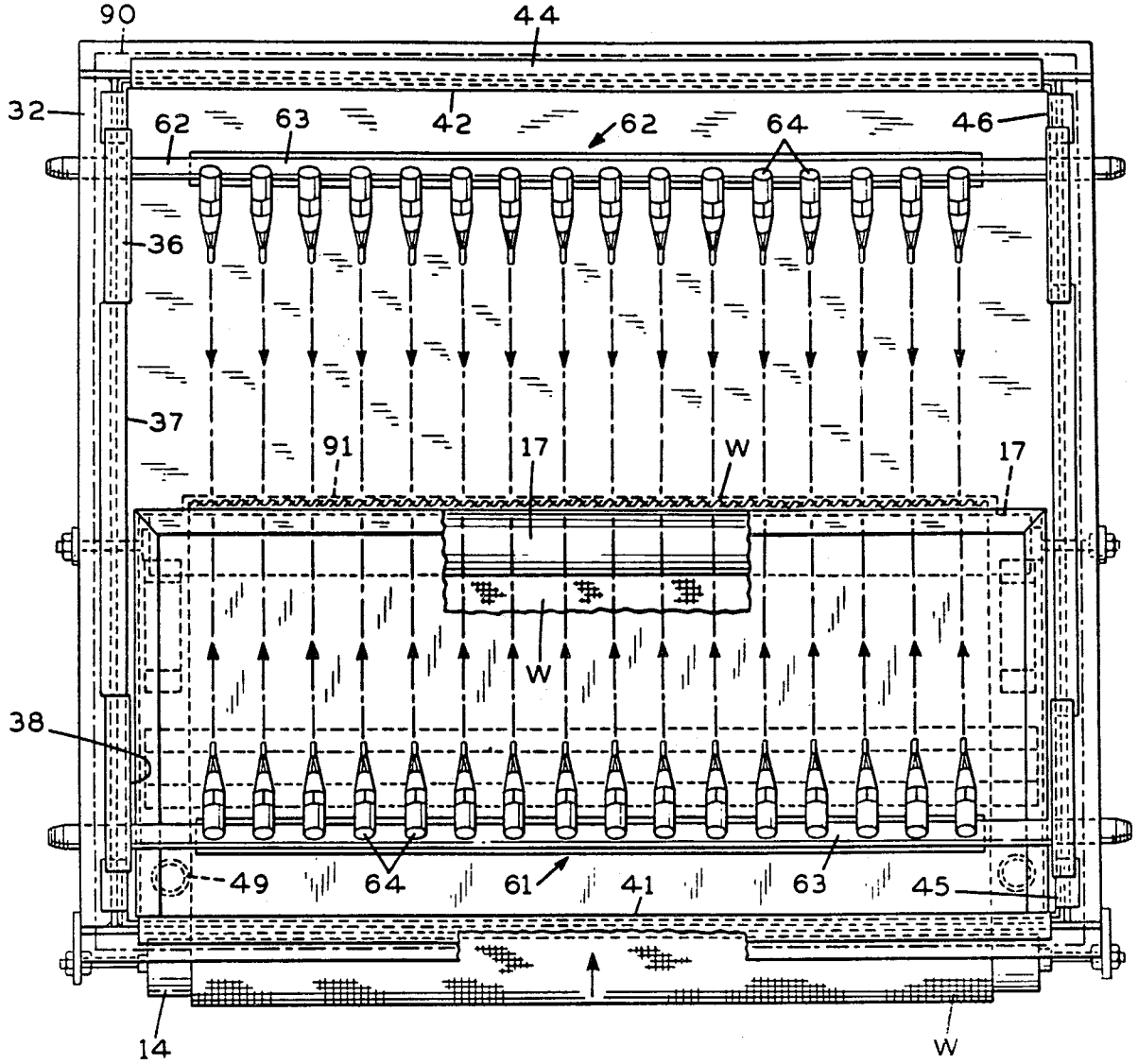
FIG. 4 is a top plan view of the moisture conditioning unit shown in FIG. 1.

As reflected in FIGS. 2 and 3, the banks of atomizing nozzles extend across the full width of the moisture conditioning chamber 18, accommodating a maximum fabric width just slightly wider than the overall width of the nozzle bank. When narrower fabric is run, it is of course possible to selectively shut off a certain number of nozzles at the outside edges, if desired.

For typical moisture conditioning of an all cotton, tubular knitted fabric, resin treated and dried, with the system operating at a speed of about twenty-five yards per minute, the banks of nozzles 64 are operated with an atomizing air pressure of, say, 40 psig and at a water pressure in the range of 15–20 psig. This results in an overall water discharge from the two banks of nozzles of, say, 15 or 20 gallons per hour of finely atomized water mist. Some of this water is evaporated in cooling the fabric, while other fractions condense in the pans 34, 47. The balance penetrates the advancing fabric web and is carried away with the fabric. With an all cotton fabric, the amount of moisture effectively absorbed by the fabric may be approximately 5% of its dry weight. Where the fabric is a blend of polyester and cotton, for example, the moisture conditioning procedure involves the absorption of lesser percentages of moisture, of course, since the polyester component is essentially hydrophobic. For such blends, the water pressure to the individual nozzles is reduced appropriately, depending upon the specific blend.

Importantly, penetration of the moisture into the fabric must be assisted by a wetting agent, so that the moisture is effectively absorbed within the fabric within a few seconds time. The wetting agent may be incorporated into the water supply leading to the atomizing nozzles, or where the fabric is resin impregnated before drying, it may be feasible to greater advantage to incorporate a so-called re-wetting agent into the resin solution. The re-wetting agent is effective, following the resin treating and drying operations, to effect quick penetration of the water into the fabric. One advantageous such re-wetting agent is sold under the trademark SORBASSIST-N, by Raytex Chemical Co. of Allentown, Pa., which can be added in amounts of about 0.5% to the resin treating solution. The term "wetting agent", as used herein, will be understood to include so-called re-wetting agents of the type referred to.

In the process of the present invention, substantial uniformity of water discharge at each of the several nozzles is important. Accordingly, the apparatus of the invention includes an advantageous form of control arrangement, shown in FIGS. 5 and 6. To begin with, it is important to be able to maintain a uniform discharge of atomized water over a continuing process run. Therefore, it is desirable to isolate the primary water system serving the mositure conditioning unit from the plant water supply, so that the incoming flow pressure is not subject to variations resulting from transient pressure variations throughout the plant. This may be achieved by providing an independent water supply tank 70, which is maintained substantially at a constant level, as by means of a suitable level control (not specifically shown). The generally constant level supply 71 in the water tank is led to the inlet side of a pressure pump 72. The outlet side of the pressure pump 72 passes through a pressure regulating valve 73 to a common header 74 associated with the flow control regulator. The primary water pressure is adjustable from the front of the control panel 75, by means of a control knob 76 associated with the pressure regulator 73. A gauge 77 indicates the primary water pressure at the output side of the regulator 73.

For each of the individual air atomizing nozzles (32 in the illustrated equipment) there is provided an individual flow control valve 78 and visual flow indicator 79. By way of example, for this purpose, the illustrated equipment utilizes a Porter F65A-V flow valve with an A250-1 stainless steel float indicator. Each flow indicator 79 is connected by a tubing 80 to the pressurized header pipe 74, and the outlet side of the indicator passes through the flow control valve and discharges through an outlet tube 81 leading directly to a specific atomizing nozzle. All of the nozzles of a single bank 60 or 61 are controlled by a given bank 82 or 83 of flow meters (the term flow meter being used to collectively include the valves 78 and flow indicator 79). This enables the locations of the specific atomizing nozzles to be easily related to the locations of the flow meters.

Figure 5:
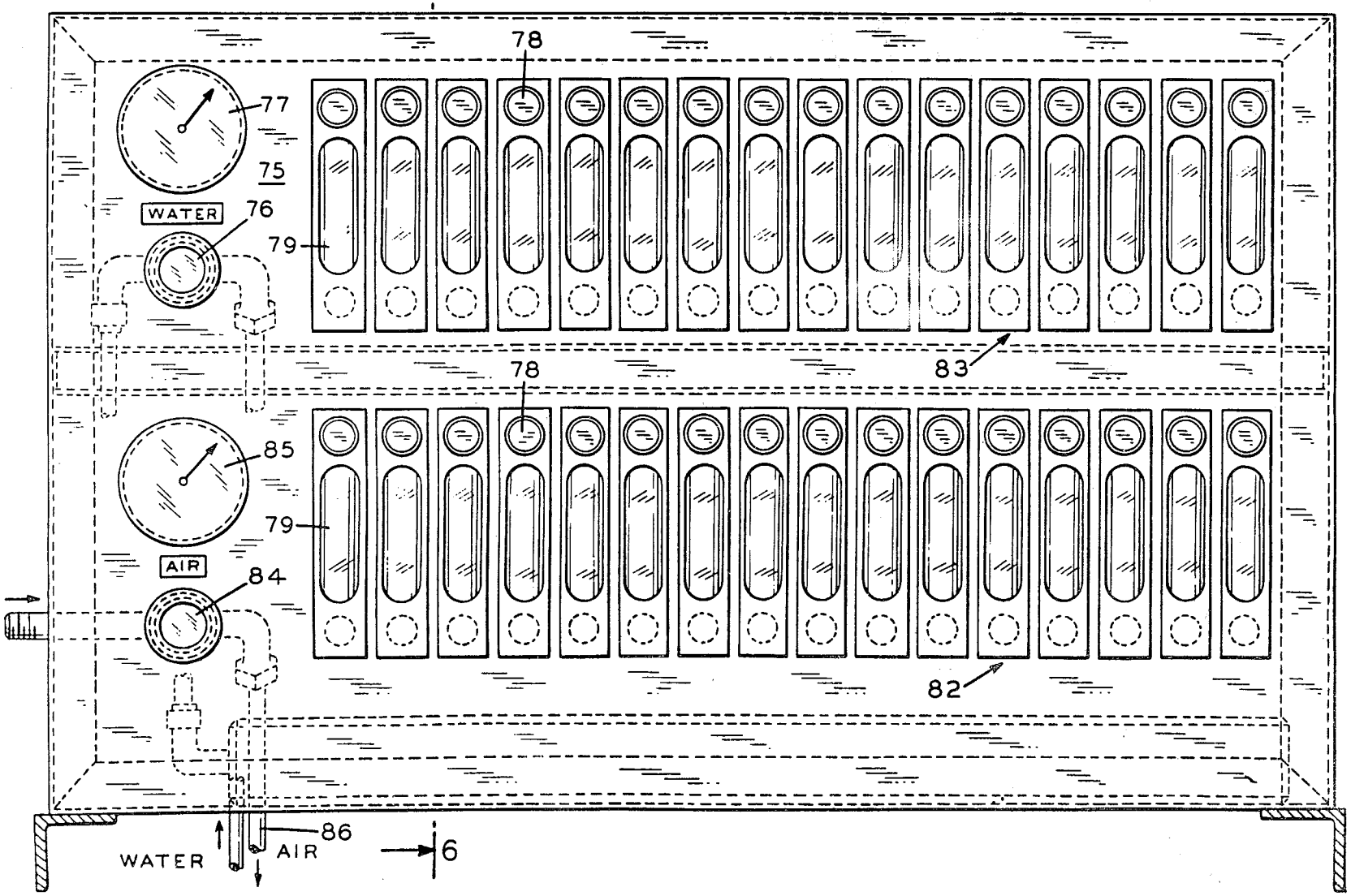
FIG. 5 is a front plan view of a control station for individual water spray nozzles utilized in the moisture conditioning apparatus.

As reflected in FIG. 5, all of the flow meters for a single bank of nozzles are arranged closely side by side, on a common level, such that visual comparison of the flow rate to each nozzle is greately facilitated. In this respect, the rate of flow through the flow meter is reflected by variable height level of an indicator in the float glass. By manipulating the several flow valves 78, it is possible to achieve an observable uniformity of water fflow to the respective nozzles, with a considerable degree of precision. In general, the individual flow valves 78 do not have to be constantly readjusted. Once the valves have been properly set, the primary control of the rate of application of atomized water is through the main pressure control regulator valve 73. However, because of inherent variations in the tolerances of the nozzles themselves, and variations in specific piping thereto, it may be necessary to readjust the individual flow rate to the nozzles after a significant change in primary pressure rates.

Air pressure to the atomizing nozzles may be controlled by a regulator 84, associated with a gauge 85, discharging through an air outlet line 86 to the common air manifolds 62, 63. Generally, it is not necessary to vary significantly the pressure of the atomizing air.

As reflected in FIG. 1, the fabric web W, after being contacted by the finely atomized sprays from the nozzle banks 60, 61, is guided upward for a substantial distance before making contact with any surface. If the moisturizing chamber is provided with a cover 90 (FIG. 2), the cover is provided with a transverse slot 91, to accommodate the passage of the fabric web W without significant contact. In one advantageous embodiment of the invention, the fabric travels vertically upward, free of contact with anything, for a distance of about six feet, until it engages and passes around the upper guide roller 19. At a typical processing rate of twenty-five yards per minute, this provides an interval of four to five seconds for the moisture to be absorbed into the fabric before the fabric comes into significant contact with a supporting surface. Even at that, it is desirable for a period of time to cause the surface contact conditions to be relatively uniform on opposite sides of the fabric, because of the tubular construction of the fabric. To this end, a second guide roll 20 is paired with the first guide roll 19, and the fabric web W is caused to be guided over and around the first roller 19, in contact with one fabric surface, and then around the second guide roll 20, in contact with the other surface of the fabric. Typically, the guide rolls 19, 20 are idler rolls, and both are approximately of the same size and surface character. The folder feed roll 22, being a driven roll, advantageously is covered with a traction material. Accordingly, it is desirable to provide for the folder entry guide roll 21 to be of a similar size and covered with a similar material, but positioned to contact the opposite side of the fabric than that contacted by the feed roll 22. Thus, in addition to providing for an initial substantial interval between cntact of the fabric with the penetrating mist and the subsequent contact with the first supporting surface (roller 19) the apparatus of the invention provides for paired rollers for engaging the fabric as it approaches and passes through the folder. This, to a substantial extent, avoids any dissimilarity in the opposite sides of the flat tubular fabric. It is to be understood, in this respect, that the opposite sides of a tubular fabric are, in effect, the same side, as both constitute outside surfaces of the fabric. The fabric edges at any given time during processing, do not necessarily represent fabric edges in a finished garment for example, so that noticeable differences in appearance from one side to the other of a tubular fabric during processing is extremely undersirable.

In a typical process carried out according to the invention, an all cotton tubular knitted fabric was resin impregnated in an extractor-pad apparatus of the general type hereinbefore described, using a continuous processing speed of about twenty-five yards per minute. After extraction of excess liquid in the pad, the fabric still contained a liquid level of about 80% of the dry weight of the fabric, and this was removed by passing the fabric through the dryer. The dryer was operated at airflow and temperature conditions adequate to drive out the moisture and then heat the dried fabric to an elevated temperature sufficient to cure the resin, typically around 325°-350° F. (163°-177° C.). The hot fabric was then directed downwardly and guided into the lower portion of the moisture conditioning unit.

With the atomizing nozzles set at approximately 40 psig air pressure and approximately 20 psig water pressure, the vertically upwardly travelling fabric was contracted by the finely atomized water mist from both sides. At a processing rate of twenty-five yards per minute, the all cotton fabric absorbed a total of about 5% by weight of moisture, which rapidly penetrated the fabric by virtue of the addition, in the resinating stage, of a suitable re-wetting agent. Not all of the moisture contacting the fabric was absorbed, however, some being evaporated in the process of cooling the fabric down from the extremely high temperature at which it was discharged from the dryer.

The fabric, after being contacted by the atomized water was conveyed vertically without contact for a couple of yards, amounting to four to five seconds of time at a twenty-five yard per minute processing speed, so that the water was effectively absorbed before the fabric contacted any surface. The fabric was then passed over guide rollers in pairs (e.g. 19, 20 and 21, 22), so that whatever effect such roller contact may have had on the fabric surface was at least somewhat balanced on both sides.

The fabric was then gathered in folded form for subsequent further processing in a finished calender.

Importantly, the moisture conditioned fabric was found to have grown noticeably in width as the result of the moisture conditioning. For example, a fabric web of forty-eight inch nominal width was found in one case to have grown an inch and a half in width as a result of the moisture conditioning. At least one half inch of width growth seems to be regularly obtainable, which is advantgeous from the standpoint of requiring less effort during subsequent lateral distention of the fabric during finish calendering, in order to set the fabric to its finished width.

After gathering, the fabric was finished on conventional calendering equipment, including a spreader propeller apparatus, steamers for applying steam to the spread fabric, and calender rolls for applying rolling pressure to the steamed and distended fabric. Calendered fabric is then again gathered in rolled or folded form for further processing, typically cutting and sewing. By way of example only, the finish calendering apparatus may be of the general type illustrated in the Frezza U.S. Pat. No. 3,875,624.

Proper moisture conditioning of the dried fabric greatly assists in the subsequent processing of the fabric, not only because of the width growth of the fabric web, but also because the fabric becomes softer and more pliable. The conditioned fabric is less prone to developing electrostatic charges. This, in addition to the greater pliability of the fabric, facilitates both calendering and, if necessary, stripe straightening operations. Subjectively, the fabric also has improved hand and feel, and thus constitutes a product of increased market quality.

In the example referred to above, the all cotton fabric had a moisture regain in the conditioning stage of about 5%. During the subsequent calendering stage, approximately 1½% additional moisture was imparted to the fabric, to provide a highly desirable level of 6½% of moisture in the calendered goods.

The amount of moisture imparted to the fabric during the moisture conditioning phase is somewhat empirical. However, the objective, generally, is to achieve a finished fabric in which the moisture level substantially corresponds to the natural moisture level in the fabric after long term normalization of the fabric moisture under average atmospheric conditions. It may be satisfactory to impart a somewhat smaller amount of moisture to the fabric in the moisture conditioning stage, where, as is typically the case, the fabric is to be steamed and calendered thereafter, and at least some additional moisture is introduced to the fabric at that time.

In the moisture conditioning of fabric, avoidance of water spotting is of particular importance, as spotted fabric is of reduced commercial quality. To this end, in the event it becomes necessary to temporarily stop the processing line with fabric in the conditioning chamber, the atomizing nozzles are disabled by terminating the flow of atomizing air only, while permitting the water to continue to flow through the nozzles. Because the water flow is at an extremely low rate, it does not project onto the fabric, but merely falls harmlessly into the condensation pans. When the line is restarted, the flow of atomizing air is returned to the nozzles, permitting the resumption of atomization of the water, without an interim period of "spitting" by the nozzles, which could result in water spotting of the fabric. Desirably, the resumption of flow of atomizing air may be "ramped", either manually or by automatic valve control, so there is a progressive resumption of full atomizing air pressure, rather than an abrupt reinstatement thereof. This also helps to avoid spotting and other discontinuities in the moisture application.

The slight downward inclination of the nozzle banks is particularly significant from the standpoint of enabling the valve to be effectively temporarily shut off, by the discontinuance of atomizing air but with the desired continued flow of water through the nozzles. Although horizontal or upwardly inclined orientation of the nozzles is adequate from the standpoint of application of moisture on a continuous basis, it can present problems during shut down of the nozzles by removal of air pressure only. Thus, with the air shut off, the desired continuing flow of water could result in some back flow of the water into the air passages of upwardly tilted nozzles, causing spitting and resultant water spotting of the fabric during restart of water atomization.

Most of the objectives of moisture conditioning have, of course, been well known for a considerable period of time. However, the process and apparatus of the present invention makes it technically feasible to achieve commercially practicable levels of moisture regain during a moisture conditioning stage, under realistic commercial operating conditions. To the useful in a practical, commercial way, the moisture conditioning of the fabric must be extremely uniform over the entire area of the fabric, not only transversely but also lengthwise. Otherwise, the fabric will not finish to be geometrically uniform. Also, great concern must be had over one possible staining of the fabric due to the fabric being touched by droplets of condensed water. Heretofore, it has not been possible to obtain the necessary uniform distribution of moisture addition together with the relatively high levels of moisture regain and still produce a product of satisfactory quality at commercially realistic rates of production.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. The process of finish treating tubular knitted fabric, which comprises the steps of (a) wet processing the fabric, (b) force drying the fabric by the application of heat to a moisture level substantially below the natural moisture level of the fabric being processed, (c) immediately after drying the fabric, while the fabric is still in a hot and dry condition, moisture conditioning the dried fabric by guiding the fabric generally vertically and directing a finely atomized mist of water in liquid form toward opposite sides of the vertically disposed fabric web in a finely controlled, uniformly distributed manner across the full width of the fabric web to impart water to the fabric in a predetermined amount whereby the moisture level of the fabric after moisture application substantially corresponds to the natural moisture level regainable by the fabric after long-term normalization of the fabric under average atmospheric conditions, (d) causing said imparted water to rapidly penetrate said fabric through the use of wetting agent means, (e) immediately thereafter continuing the vertical guiding of said fabric for a predetermined period in the absence of significant contact by any apparatus structure with the surface of said fabric to facilitate water absorption by and penetration into the fabric, and (f) thereafter guiding said fabric to a gathering station through an apparatus structure arranged and configured whereby the apparatus-fabric surface contact conditions are relatively uniform on opposite sides of the fabric, and gathering the fabric for further processing.

2. The process of claim 1, further characterized by said gathered fabric being further processed by being spread to width, steamed and calendered.

3. The process of claim 1, further characterized by the portions of said fabric web below the region of application of said mist being shielded from said mist and from condensate formed by said mist.

4. The process of claim 1, further characterized by said finely atomized mist being applied by air atomizing of a large plurality of closely transversely spaced water streams, and directing said atomized streams toward the fabric web from opposite sides thereof.

5. The process of claim 4, further characterized by said atomized streams being oriented downward at an acute angle to the horizontal and arranged to intersect with the fabric web generally along a common transverse axis.

6. The process of claim 1, further characterized by (a) said fabric web being guided to said gathering station by contacting a pair of guide rollers, (b) said fabric being guided around said guide rollers in a manner to provide roller contact with both sides of the fabric.

7. The process of claim 6, further characterized by (a) said fabric after passing around said first pair of guide rollers, being guided around a second pair of guide rollers so as to make surface contact with both sides of the fabric web, (b) the rollers of the first pair having generally similar surface characteristics, and the rollers of said second pair having generally similar surface characteristics, not necessarily the same as the characteristics of the first pair of rollers.

8. The method of claim 1, further characterized by said fabric, after said force drying, comprising a dry, resinated fabric, at a temperature substantially above the boiling point of water.

9. The method of claim 8, further characterized by said resinated fabric including a wetting agent.

* * * * *